US011910835B2

(12) United States Patent
Chen et al.

(10) Patent No.: US 11,910,835 B2
(45) Date of Patent: Feb. 27, 2024

(54) ELECTRONIC ATOMIZING DEVICE AND ATOMIZER THEREOF

(71) Applicant: SHENZHEN SMOORE TECHNOLOGY LIMITED, Shenzhen (CN)

(72) Inventors: Songkai Chen, Guangdong (CN); Jiyong Yang, Shenzhen (CN); Jingjing Yang, Shenzhen (CN); Mingshu Li, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 315 days.

(21) Appl. No.: 17/313,012

(22) Filed: May 6, 2021

(65) Prior Publication Data

US 2021/0345675 A1 Nov. 11, 2021

(30) Foreign Application Priority Data

May 9, 2020 (CN) ..... 202020752448.X

(51) Int. Cl.
*A24F 40/485* (2020.01)
*A24F 40/42* (2020.01)
(Continued)

(52) U.S. Cl.
CPC ..... *A24F 40/485* (2020.01); *A24F 40/42* (2020.01); *A24F 40/51* (2020.01); *A24F 40/53* (2020.01)

(58) Field of Classification Search
CPC ..... A24F 40/485; A24F 40/42; A24F 40/40; A24F 40/51
See application file for complete search history.

(56) References Cited

U.S. PATENT DOCUMENTS 11,259,572 B2 * 3/2022 Wang ..... A24F 40/485
11,284,645 B2 * 3/2022 Wang ..... A24F 40/48
(Continued)

FOREIGN PATENT DOCUMENTS

CN 206714091 U 12/2017
CN 208891731 U 5/2019
(Continued)

OTHER PUBLICATIONS

The extended European Search Report of European Patent Application No. 21171610.5 dated Oct. 13, 2021.

*Primary Examiner* — Hae Moon Hyeon
(74) *Attorney, Agent, or Firm* — Andrew C. Cheng

(57) ABSTRACT

The present disclosure provides an electronic atomizing device and an atomizer thereof. The atomizer includes a housing. An atomization cavity is defined in the housing. An air inlet passage and an air sensing passage which are in communication with the outside are defined in the housing. The air inlet passage is in communication with the atomization cavity. At least part of the air sensing passage and at least part of the air inlet passage are arranged side-by-side and independently of each other, so that the atomizer can prevent mutual interference of airflows in the air sensing passage and the air inlet passage, prevent contamination to the pneumatic switch caused by contact between the airflow in the air sensing passage and the liquid atomizable medium, thereby avoiding reduced sensitivity and shortened life of the pneumatic switch.

19 Claims, 11 Drawing Sheets

(51) Int. Cl.

| | |
|---|---|
| ***A24F 40/40*** | (2020.01) |
| ***A24F 40/53*** | (2020.01) |
| ***A24F 40/51*** | (2020.01) |

(56) References Cited

U.S. PATENT DOCUMENTS

| | | | | |
|---|---|---|---|---|
| 11,382,354 | B2 * | 7/2022 | Chen | A24F 40/10 |
| 2018/0303162 | A1 * | 10/2018 | Zhang | A24F 40/485 |
| 2021/0084975 | A1 * | 3/2021 | Xu | A24F 40/46 |
| 2021/0084976 | A1 * | 3/2021 | Xu | A24F 40/485 |

FOREIGN PATENT DOCUMENTS

| | | | | |
|---|---|---|---|---|
| CN | 209031257 | U * | 6/2019 | A24F 40/42 |
| WO | 2016066635 | A1 | 5/2016 | |
| WO | 2018191766 | A1 | 10/2018 | |

* cited by examiner

ELECTRONIC ATOMIZING DEVICE AND ATOMIZER THEREOF

TECHNICAL FIELD

The present disclosure relates to an atomization device, more particularly, to an electronic atomizing device and an atomizer thereof.

DESCRIPTION OF RELATED ART

The electronic atomizing device in the related art is mainly composed of an atomizer and a power supply assembly. The atomizer is configured to atomize a liquid atomizable medium, and the power supply assembly is configured to supply power to the atomizer. Generally, the power supply assembly includes an airflow sensor (commonly known as a "pneumatic switch"). When a user inhales, the pneumatic switch senses an air flowing and transmits a signal to electrify the atomizer. In the related art, the pneumatic switch is in communication with an airflow passage, and may come into contact with the liquid atomizable medium, resulting in damage to sensitivity and service life of the pneumatic switch.

BRIEF SUMMARY OF THE DISCLOSURE

The technical problem to be solved by the present disclosure is to provide an improved atomizer and an electronic atomizing device with the improved atomizer.

The technical solution adopted by the present disclosure to solve the technical problem is to provide an atomizer including a housing. An atomization cavity is defined in the housing; an air inlet passage and an air sensing passage which are in communication with the outside are defined in the housing; the air inlet passage is in communication with the atomization cavity, and at least part of the air sensing passage and at least part of the air inlet passage are arranged side-by-side and independent of each other.

In some embodiments, the air sensing passage and the air inlet passage are arranged completely independently of each other.

In some embodiments, the air sensing passage and the air inlet passage are arranged along the longitudinal direction of the housing and are parallel to each other.

In some embodiments, the housing is provided with a first air inlet in communication with the air inlet passage.

In some embodiments, the housing is provided with a second air inlet in communication with the air sensing passage.

In some embodiments, the housing includes a top end and a bottom end opposite to the top end, and the first air inlet and the second air inlet are arranged close to the top end of the housing.

In some embodiments, an air outlet passage in communication with the atomization cavity and the outside is provided in the housing for outputting aerosol.

The air outlet passage and the air inlet passage are respectively located at two opposite sides of the housing.

In some embodiments, the housing includes a shell, a first partition wall, and a second partition wall. The first partition wall is arranged in the shell along the longitudinal direction of the shell with a first space defined between the first partition wall and the side wall of the shell.

The second partition wall is arranged in the shell along a longitudinal direction and is located between the first partition wall and a side wall of the shell to divide the first space into the air sensing passage and the air inlet passage.

The housing further includes a third partition wall which is arranged in the shell along the longitudinal direction and is opposite to and spaced apart from the first partition wall. A second space is defined between the third partition wall and a side wall of the shell, and the second space defines the air outlet passage.

In some embodiments, the atomizer further includes a base and an atomization assembly arranged on the base; the housing is sleeved on the base; the atomization assembly is arranged in the housing. The base includes a base body, and a first support structure and a second support structure which are arranged on the base body to support the atomization assembly. The first support structure and the second support structure are arranged opposite to each other.

In some embodiments, the first support structure is provided with a first air inlet hole in communication with the air inlet passage and the atomization cavity. The second support structure is provided with a first air outlet hole in communication with the atomization cavity and the air outlet passage.

In some embodiments, the atomization assembly includes a porous body which includes an atomizing surface facing the atomization cavity. The location of the first air outlet hole is higher than or equal to that of the atomizing surface.

In some embodiments, the atomizer further includes a seat sleeved on a lower portion of the housing and a sealing member arranged between the seat and the base body. The sealing member is provided with at least one air pipe in communication with the air sensing passage. The seat is provided with at least one via hole corresponding to the at least one air pipe.

In some embodiments, two air pipes are provided and arranged symmetrically.

In some embodiments, the at least one air pipe protrudes from an end surface of an end of the seat away from the housing.

The present disclosure further provides an electronic atomizing device which includes the atomizer described above and a power supply assembly connected with the atomizer. The power supply assembly includes a pneumatic switch in fluid communication with the air sensing passage.

In some embodiments, the electronic atomizing device further includes a second air inlet hole arranged on the power supply assembly for communicating the air sensing passage of the atomizer with the pneumatic switch.

The electronic atomizing device and an atomizer thereof according to the disclosure have the following beneficial effects: by arranging the air sensing passage and the air inlet passage in the housing at least partially independently and side-by-side, the atomizer can avoid mutual interference of airflows in the air sensing passage and the air inlet passage, avoid contamination to the pneumatic switch caused by contact between the airflow in the air sensing passage and the liquid atomizable medium, thereby avoiding reduced sensitivity and shortened life of the pneumatic switch.

BRIEF DESCRIPTION OF THE DRAWINGS

The disclosure will be further described with reference to the accompanying drawings and specific embodiments. In the drawings.

PREFERRED EMBODIMENTS

To clearly understand the technical features, objectives and effects of the disclosure, the specific embodiments of the disclosure will now be described in detail with reference to the accompanying drawings.

It should be understood that the terms, such as "front", "rear", "left", "right", "upper", "lower", "first", and "second" are only for the convenience of describing the technical solution of the disclosure, rather than indicating that the device or element referred to must have special differences, and therefore cannot be understood as a limitation of the disclosure. It should be noted that when an element is considered as being "connected" to another element, the element may be directly connected to another element or there may be an intermediate element therebetween. Unless otherwise defined, all technical and scientific terms used herein have the same meanings as the ordinary understandings of those skilled in the technical field to which the disclosure belongs. Terms used in the specification of the disclosure herein are only for describing specific embodiments, not for limiting the disclosure.

Figure 1:
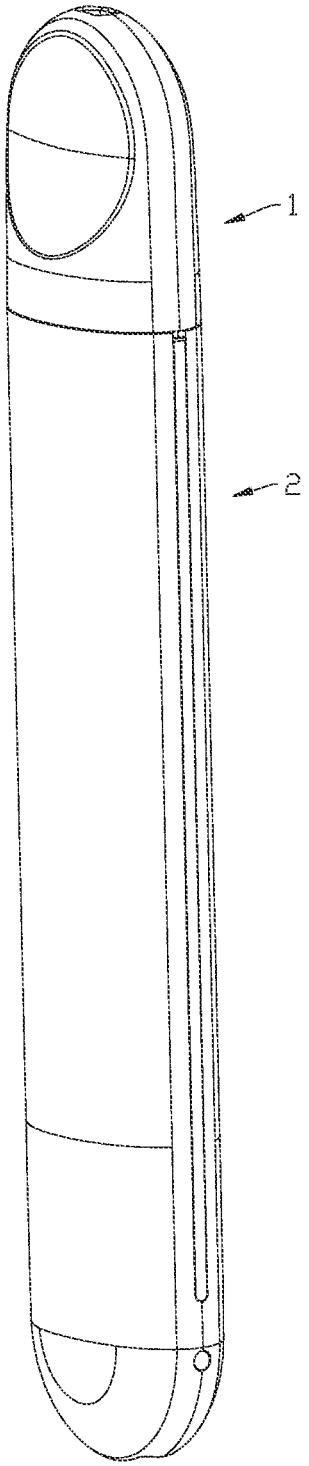
FIG. 1 is a perspective view of an electronic atomizing device in some embodiments of the disclosure.
Figure 2:
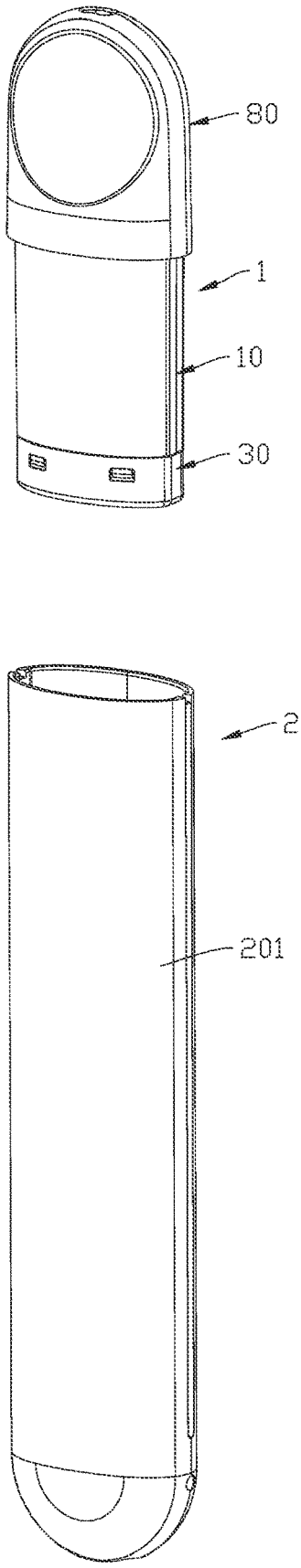
FIG. 2 is an exploded view of the electronic atomizing device shown in FIG. 1.
Figure 3:
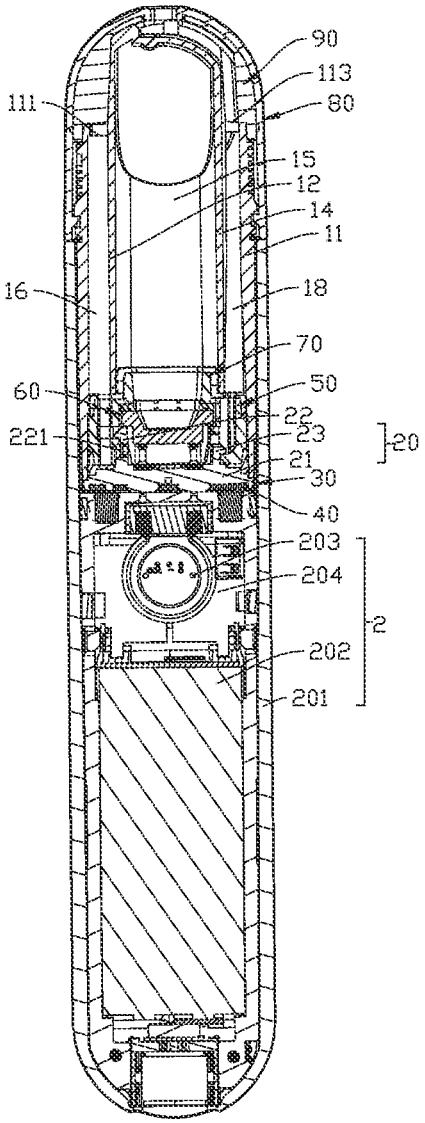
FIG. 3 is a cross-sectional view of the electronic atomizing device shown in FIG. 1.

FIGS. 1 to 3 show an electronic atomizing device in some embodiments of the disclosure. The electronic atomizing device can be applied to atomization of liquid atomizable medium such as liquid tobacco or medicine, and includes an atomizer 1 and a power supply assembly 2 mechanically and electrically connected to the atomizer 1.

As shown in FIGS. 4 to 7, in some embodiments, the atomizer 1 further includes a housing 10 and a base 20. The housing 10 is sleeved on the base 20, and can have a hollow structure inside. The base 20 is arranged at an open end of the housing 10 and configured to seal the opening of the housing 10.

Referring to FIGS. 4 to 7 and FIGS. 9 to 10, in some further embodiments, the housing 10 includes a shell 11, a first partition wall 12, a second partition wall 13, and a third partition wall 14. The inner side of the shell 11 is hollow. The housing 10 includes a top end and a bottom end. Specifically, the top end and the bottom end are respectively arranged at two ends of the shell 11 and are opposite to each other. The first partition wall 12 is arranged in the shell 11 in a longitudinal direction, and a first space is defined between the first partition wall 12 and an inner side wall of one side of the shell 11. The second partition wall 13 can be arranged in the shell 11 in a longitudinal direction, and is located in the first space and intersects with the first partition wall 12, so that the first space is divided into an air sensing passage 17 and an air inlet passage 16. The third partition wall 14 can be arranged in the shell 11 in a longitudinal direction, opposite to and spaced apart from the first partition wall 12, and the space between the third partition wall 14 and the first partition wall 12 can define a liquid storage cavity 15 for storing the liquid atomizable medium. A second space is defined between the third partition wall 14 and a side wall of the shell 11 and opposite to the first space. The second space can be configured to define an air outlet passage 18.

Further, in some embodiments, a cross section of the shell 11 is oval. It is understandable that in some other embodiments, the cross section of the shell 11 is not limited to being oval. The housing 10 is provided with a first air inlet 111, a second air inlet 112 and an air outlet 113. The first air inlet 111, the second air inlet 112 and the air outlet 113 are all arranged on the shell 11. The first air inlet 111 is in communication with the air inlet passage 16, and is configured to allow external air to enter the air inlet passage 16. The second air inlet 112 and the first air inlet 111 may be arranged side-by-side. The second air inlet 112 is in communication with the air sensing passage 17, and is configured to allow external air to enter the air sensing passage 17. In other embodiments, the first air inlet 111 and the second air inlet 112 may be defined as the same single one. The first air inlet 111 and the second air inlet 112 can be arranged on an upper portion of the shell 11 and close to the top of the housing 10. Specifically, the first air inlet 111 and the second air inlet 112 can be arranged close to the top of the shell 11 so as to be able to alleviate the liquid leakage problem of the air sensing passage 17 and the air inlet passage 16 at the bottom. The air outlet 113 is arranged on the upper portion of the shell 11 and close to the top of the shell 11. The air outlet 113 and the first air inlet 111 are respectively located on two opposite sides of the shell 11. The air outlet 113 is in communication with the air outlet passage 18 to thereby communicate the air outlet passage 18 with the outside so that the aerosol can be transferred out from the air outlet passage 18.

Further, in some embodiments, the air inlet passage 16 is arranged along a longitudinal direction of the housing 10. In some embodiments, one end of the air inlet passage 16 communicates with the outside through the first air inlet 111, and another end of the air inlet passage 16 can communicate with an atomization cavity 51 arranged inside the housing 10. When the user inhales, external air enters the air inlet passage 16 through the first air inlet 111 and then enters the atomization cavity 51.

Further, in some embodiments, the air sensing passage 17 is arranged along a longitudinal direction of the housing 10 and in parallel with the air inlet passage 16. Spaced apart by the second partition wall 13, the air sensing passage 17 and the air inlet passage 16 are arranged independently of each other side-by-side in the housing 10, and are located on the same side of the housing 10. Specifically, the air inlet passage 16 and the air sensing passage 17 are arranged at the same end of a long axis of a cross section of the housing 10. By arranging the air inlet passage 16 and the air sensing passage 17 on the same side of the housing 10 and independently of each other, the air flow of the air inlet passage 16 and the air sensing passage 17 may not interfere with each other. Moreover, the air sensing passage 17 does not need to be in communication with the atomization cavity 51, which prevents the air flow in the air sensing passage 17 from coming into contact with the liquid atomizable medium and causing the pneumatic switch to be contaminated, thereby avoiding the reduced sensitivity and shortened life of the pneumatic switch, and improving the inhaling experience of the user. It is understandable that in some other embodiments, the air inlet passage 16 and the air sensing passage 17 may not be completely independent, and they may be partially independently arranged. Specifically, in some embodiments, the air inlet passage 16 includes a first air inlet section, and a second air inlet section communicating with the first air inlet section. The air sensing passage 17 includes a third air inlet section and a fourth air inlet section communicating with the third air inlet section. The third air inlet section and the first air inlet section are defined as the same section, and the second air inlet section and the fourth air inlet section are arranged independently of each other.

Further, in some embodiments, the air outlet passage 18 is arranged in the housing 10 along a longitudinal direction, and the air outlet passage 18 and the air inlet passage 16 are respectively located at two opposite sides of the housing 10. Compared with some embodiments where the air outlet passage is arranged in the center of the housing 10, the housing 10 of this embodiment is more manufacturable, and the internal space of the housing 10 can be maximally utilized, so that the liquid volume of the liquid storage cavity 15 in the housing 10 can be maximized. One end of the air outlet passage 18 is in communication with the atomization cavity 51, and another end of the air outlet passage 18 is in communication with the air outlet 113. The aerosol formed by atomization can pass through the air outlet passage 18 and then be sent out through the air outlet 113 for the user to inhale. In some embodiments, the inner side wall of the air outlet passage 18 can be provided with a liquid absorption groove 181 which can be arranged along a longitudinal direction of the air outlet passage 18. The liquid absorption groove 181 has a capillary structure that can be used to absorb condensate. Certainly, it is understandable that in some other embodiments, the liquid absorption groove 181 may be omitted. In some embodiments, a plurality of liquid absorption grooves 181 may be provided. Certainly, it is understandable that in some other embodiments, the number of liquid suction grooves 181 is not limited to multiple.

As shown in FIG. 5, FIG. 10, FIG. 11, and FIG. 12, further, in some embodiments, the base 20 includes a base body 21, a first support structure 22, and a second support structure 23. The base body 21 can be arranged at the open end of the housing 10 to seal the opening of the housing 10. The first support structure 22 and the second support structure 23 can extend into the housing 10 and be used to support an atomization assembly 60 arranged in the housing 10. In some embodiments, the first support structure 22 and the second support structure 23 are arranged oppositely and spaced apart from each other, and are respectively arranged perpendicularly to the base body 21 and integrally formed with the base body 21. In some embodiments, the first support structure 22 and the second support structure 23 may be integrally formed with the base body 21 by injection molding or casting.

Further, in some embodiments, a shape and a dimension of a cross section of the base body 21 are conformed with a shape and a dimension of a cross section of the housing 10. In some embodiments, the cross section of the base body 21 is oval, the base body 21 is provided with a second air outlet hole 211 which extends along a thickness direction of the base body 21. One end of the second air outlet hole 211 can communicate with the air sensing passage 17. An air guiding groove 212 is provided on a side of the base body 21 opposite to the first support structure 22 and the second support structure 23. Another end of the second air outlet hole 211 is in communication with the air guiding groove 212. The airflow in the air sensing passage 17 can enter the air guiding groove 212 through the second air outlet hole 211. The air guiding groove 212 can be curved, and two air outlet ports 2121 can be symmetrically provided on the air guiding groove 212 to facilitate output of the airflow in the air guiding groove 212. In some embodiments, the base body 21 is provided with mounting holes 214, and the mounting holes 214 can be configured for mounting electrode elements 100. In some embodiments, two mounting holes 214 can be provided.

Further, in some embodiments, the first support structure 22 is located at a side adjacent to the air inlet passage 16, and the first support structure 22 may be a baffle, which can be used to alleviate leakage of the liquid atomizable medium from the atomization cavity 51 into the air inlet passage 16. The first support structure 22 is provided with a first air inlet hole 221 which can communicate the air inlet passage 16 with the atomization cavity 51 and is configured to allow the air in the air inlet passage 16 to enter the atomization cavity 51.

Further, in some embodiments, the second support structure 23 is located on a side adjacent to the air outlet passage 18, and the second support structure 23 can be a baffle, which can be used to alleviate leakage of the liquid atomizable medium from the atomization cavity 51 into the air outlet passage 18. The second support structure 23 is provided with a first air outlet hole 231. The first air outlet hole 231 can be arranged on the second support structure 23, and communicates the atomization cavity 51 with the air outlet passage 18, to allow the aerosol to output into the air outlet passage 18 from the atomization cavity 51.

Figure 4:
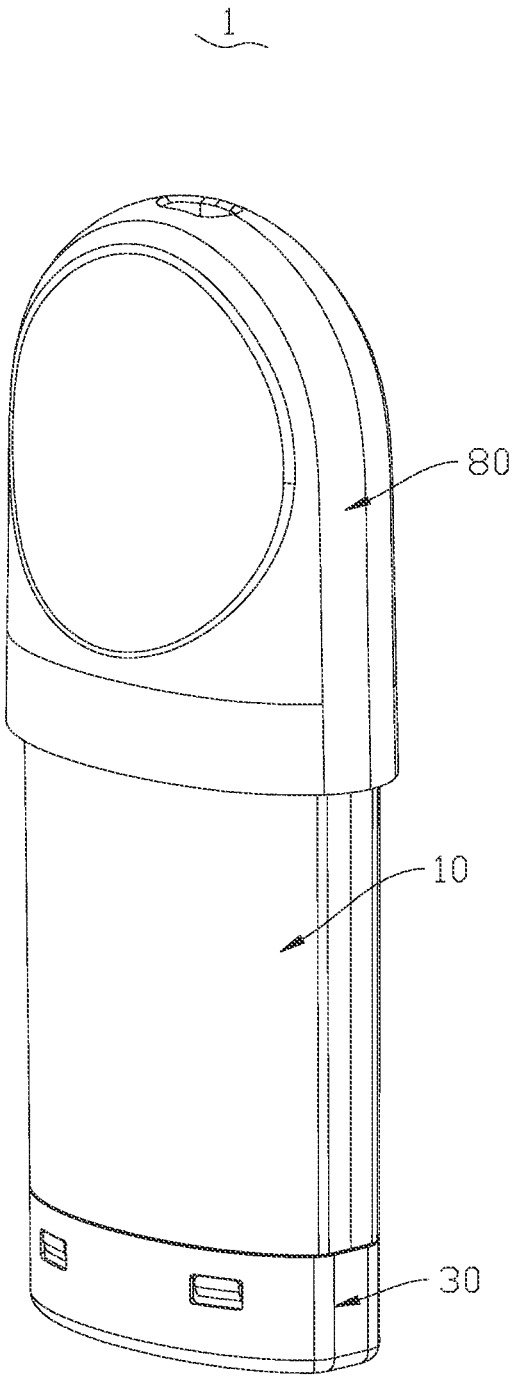
FIG. 4 is a perspective view of the atomizer of the electronic atomizing device shown in FIG. 1.
Figure 13:
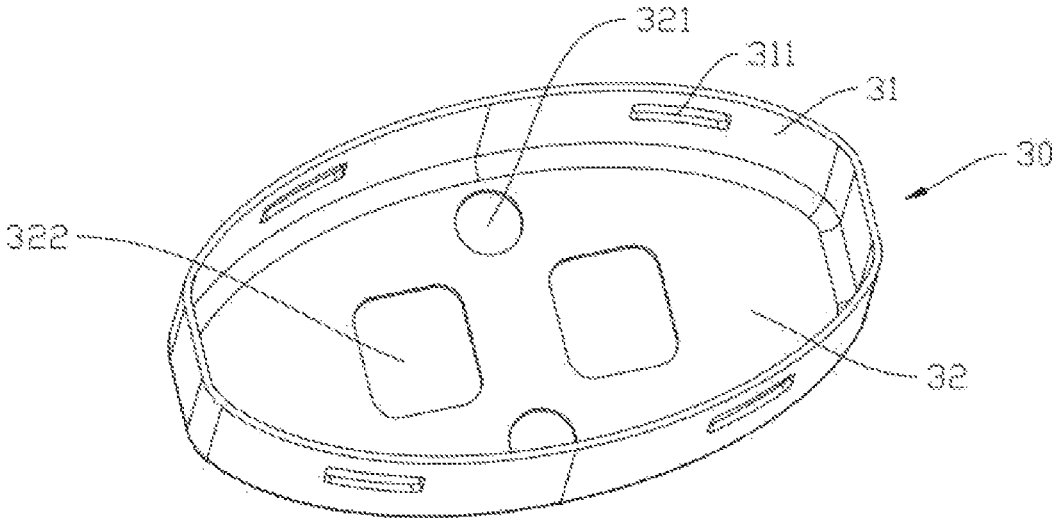
FIG. 13 is a perspective view of the seat of the atomizer shown in FIG. 8.

As shown in FIGS. 4 and 13, further, in some embodiments, the atomizer further includes a seat 30. The seat 30 is sleeved on the lower portion of the housing 10 and is detachably connected to the housing 10. The seat 30 may be a metal seat. A cross section of the seat 30 may be oval, and the seat 30 may include a side wall 31 and a bottom wall 32. The side wall 31 can be formed by extending a periphery of the bottom wall 32 in a direction which is substantially perpendicular to the bottom wall 32. The side wall 31 and the bottom wall 32 cooperatively define a receiving cavity. The seat 30 can be detachably connected to the housing 10 through a connection structure. Specifically, in some embodiments, the connection structure 30 may include a buckle 114 and a locking hole 311. The buckle 114 can be arranged on an outer side wall of the shell 11 and located at the lower portion of the shell 11 and protrudes from the outer side wall of the shell 11. The locking hole 311 can be arranged on the side wall 31 and correspond to the buckle 114 to allow the buckle 114 to be engaged in. The bottom wall 32 may be provided with one or more via holes 321 which may facilitate output of air to the power supply assembly 2. The bottom wall 32 is provided with one or more avoidance holes 322. Two avoidance holes 322 are provided which can avoid the bottom wall 32 interfering with the two electrode elements 100.

Figure 8:
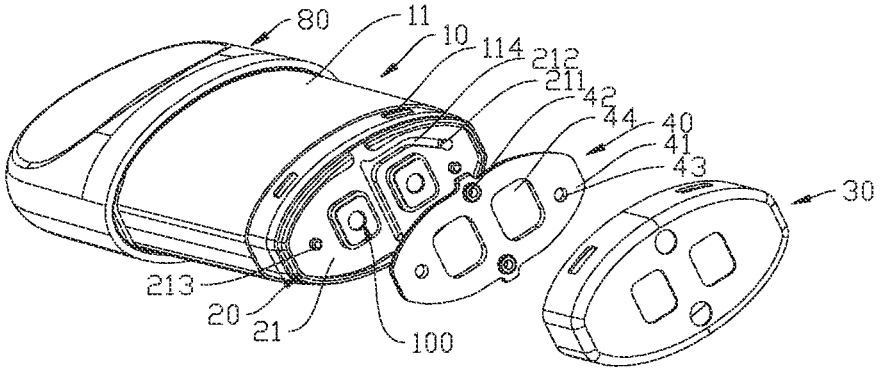
FIG. 8 is a partly exploded view of the atomizer shown in FIG. 1.
Figure 9:
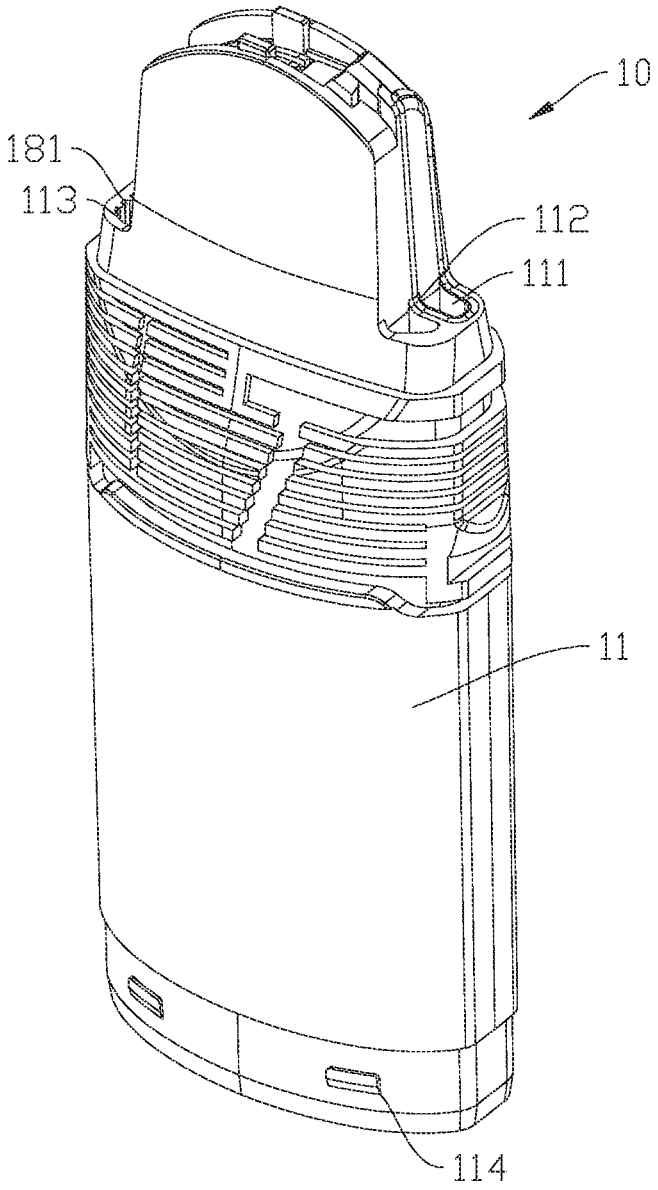
FIG. 9 is a perspective view of the housing of the atomizer shown in FIG. 8.
Figure 10:
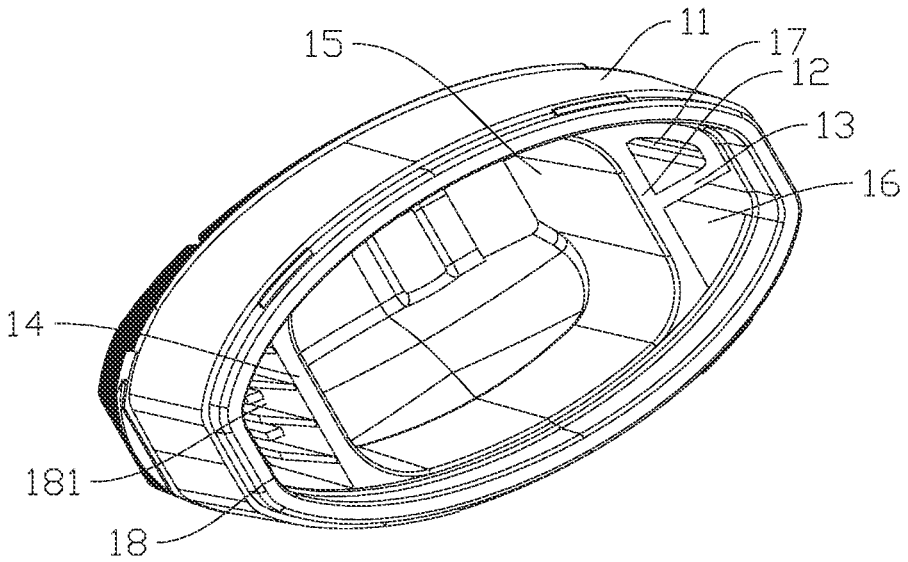
FIG. 10 is a perspective view of the housing shown in FIG. 9, viewed from another direction.
Figure 14:
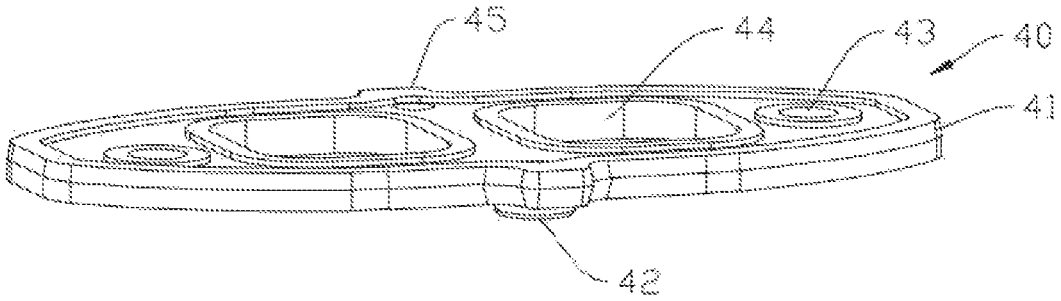
FIG. 14 is a perspective view of the sealing member of the atomizer shown in FIG. 8.

As shown in FIGS. 8 and 14, further, in some embodiments, the atomizer further includes a sealing member 40. The sealing member 40 can be arranged on the base body 21 and can be located between the base body 21 and the seat 30. In some embodiments, the sealing member 40 may be made of an elastic material. Specifically, in some embodiments, the sealing member 40 may be silicone. Specifically, a receiving groove 210 may be defined on the base body 21, and the sealing member 40 may be received in the receiving groove 210. The sealing member 40 may include a body 41, and the body 41 may be a gasket. The sealing member 40 further includes at least one air pipe 42 arranged on the body 41. Two air pipes 42 may be provided which can communicate with the air guiding groove 212. Specifically, the two air pipes 42 can be arranged corresponding to the two air outlet ports 2121 of the air guiding groove 212 respectively, thereby allowing air to output from the air guiding groove 212 to the power supply assembly 2. The air pipes 42 can be integrally formed with the body 41. Specifically, in some embodiments, the air pipes 42 and the body 41 may be integrally formed by injection molding. The two air pipes 42 may be symmetrically arranged. By arranging the two air pipes 42 symmetrically, the atomizer 1 and the power supply assembly 2 can be assembled without needing to consider an assembly direction, thereby achieving a foolproof effect. The air pipes 42 can be arranged corresponding to via holes 321, and can extend through the via holes 321 and protrude from an end surface of an end of the seat 30 away from the housing 10. When the atomizer 1 and the power supply assembly 2 are assembled, one of the air pipes 42 can communicate with the pneumatic switch in the power supply assembly 2, and another air pipe 42 can be blocked, which can avoid affecting the sensitivity of the pneumatic switch due to air leakage.

Further, in some embodiments, a positioning structure may be provided on the base body 21 and the sealing member 40. Specifically, in some embodiments, the positioning structure may include one or more positioning columns 213 and one or more positioning holes 43. The positioning columns 213 may be arranged on the base body 21, and two positioning columns 213 may be provided. The two positioning columns 213 can be spaced apart from each other and arranged on one side of the base body 21 opposite to the first support structure 22 and the second support structure 23. The positioning holes 43 may be defined in the sealing member 40. Two positioning holes 43 may be provided, and may be arranged corresponding to the two positioning columns 213, and the positioning holes 43 may cooperate with the positioning columns 213 to implement positioning. When the sealing member 40 is received in the receiving groove 210, the positioning columns 213 can extend through the positioning holes 43.

Further, in some embodiments, one or more through holes 44 may be provided in the body 41. The through holes 44 can be square, and can be arranged corresponding to the mounting holes 214. Two through holes 44 may be provided, and can be arranged side-by-side.

Further, in some embodiments, a limiting structure is further arranged on the base body 21 and the sealing member 40. The limiting structure includes one or more limiting grooves 215 and one or more limiting bosses 45. The limiting grooves 215 can be arranged on a side wall of the receiving groove 120 of the base body 21. Two limiting grooves 215 may be provided oppositely to each other. The limiting bosses 45 can be arranged on a side wall of the body 41, and two limiting bosses 45 may be provided. The two limiting bosses 45 are arranged corresponding to the two limiting grooves 215 and can be snapped in the limiting grooves 215. Understandably, in some other embodiments, the number of the limiting grooves 215 and the number of the limiting bosses 45 are not limited to two.

Figure 5:
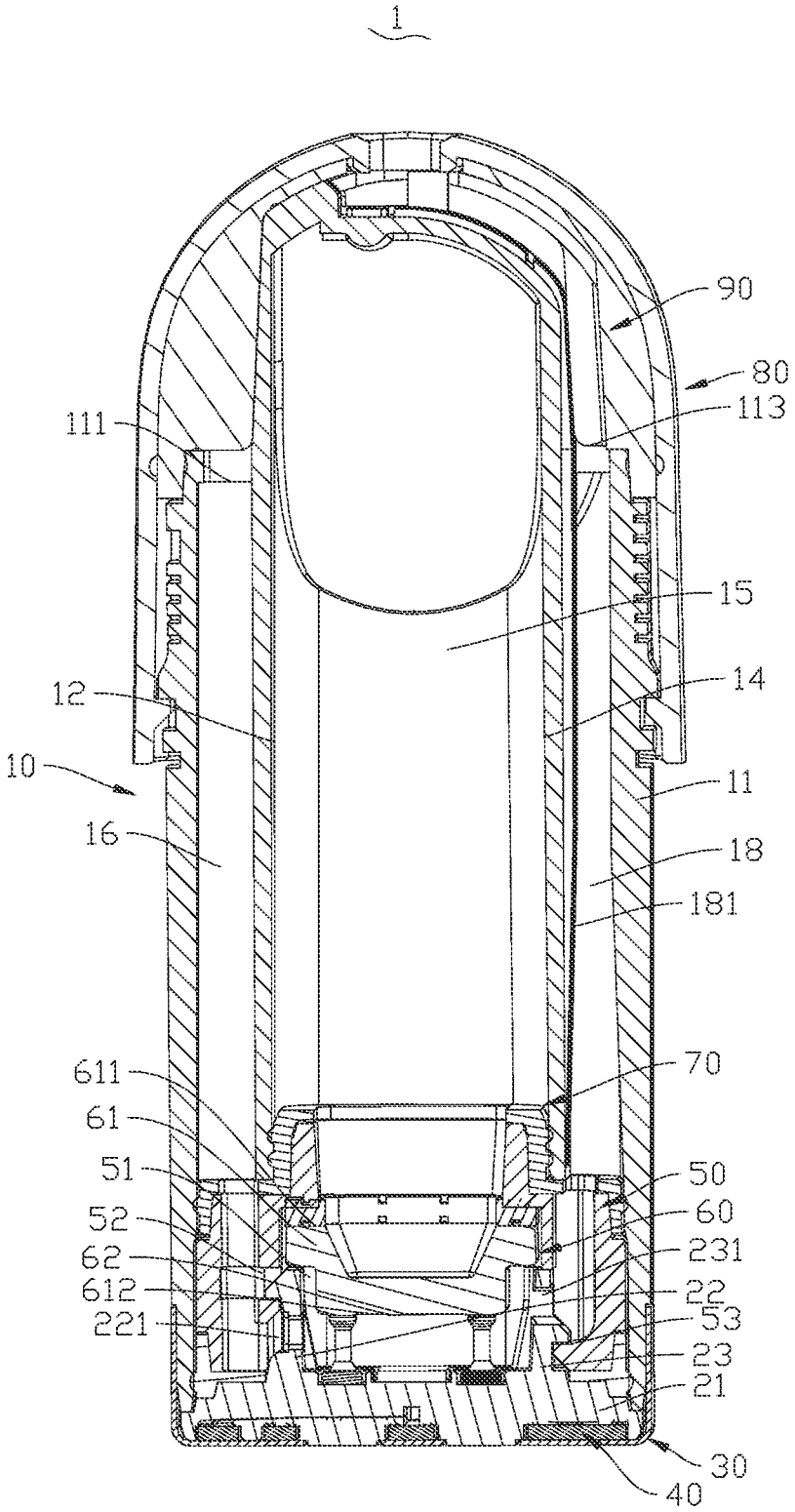
FIG. 5 is a cross-sectional view of the atomizer shown in FIG. 1.
Figure 6:
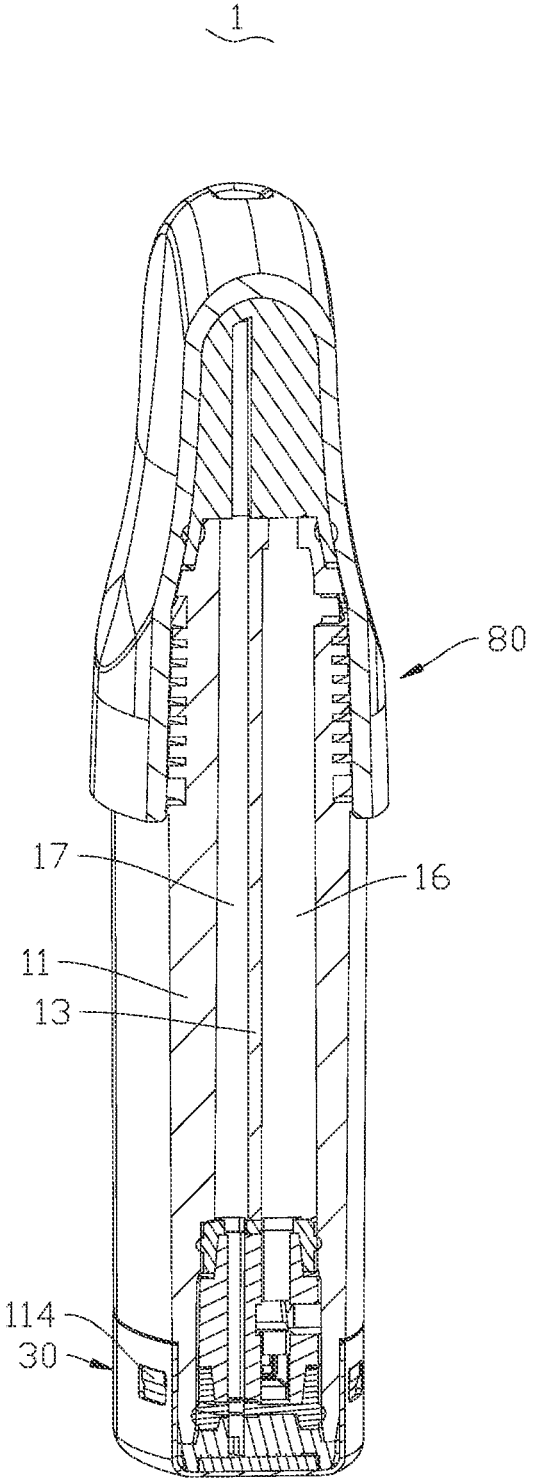
FIG. 6 is a cross-sectional view of the atomizer shown in FIG. 1, viewed from another direction.
Figure 7:
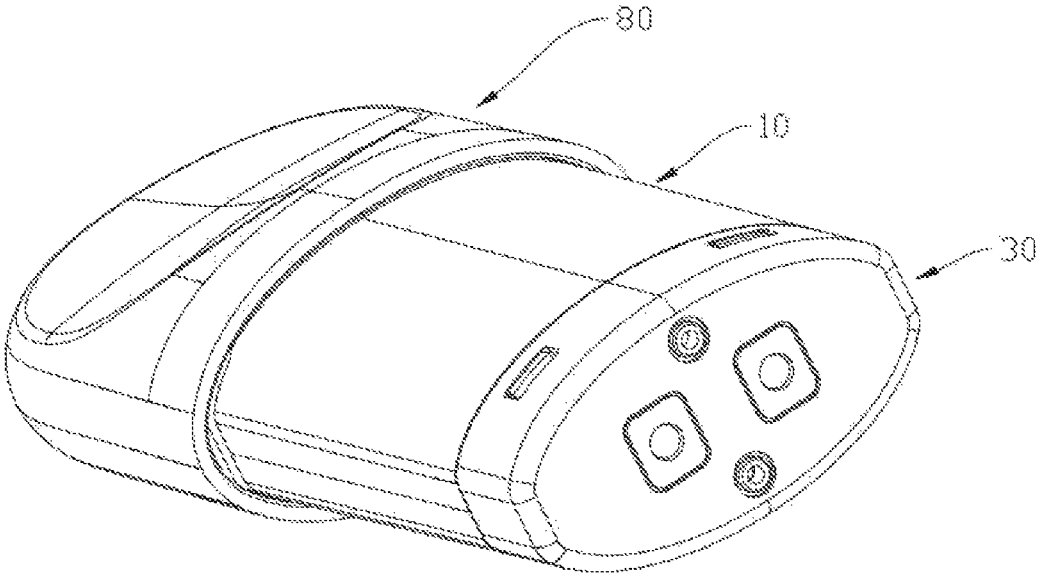
FIG. 7 is a perspective view of the atomizer shown in FIG. 1, viewed from another direction.

As shown in FIGS. 3 and 5, the atomizer further includes an atomization sleeve 50. The atomization sleeve 50 can be sleeved on the base 20. In some embodiments, the atomization sleeve 50 may be a hollow tubular structure, and the atomization cavity 51 may be defined inside the atomization sleeve 50.

Figure 11:
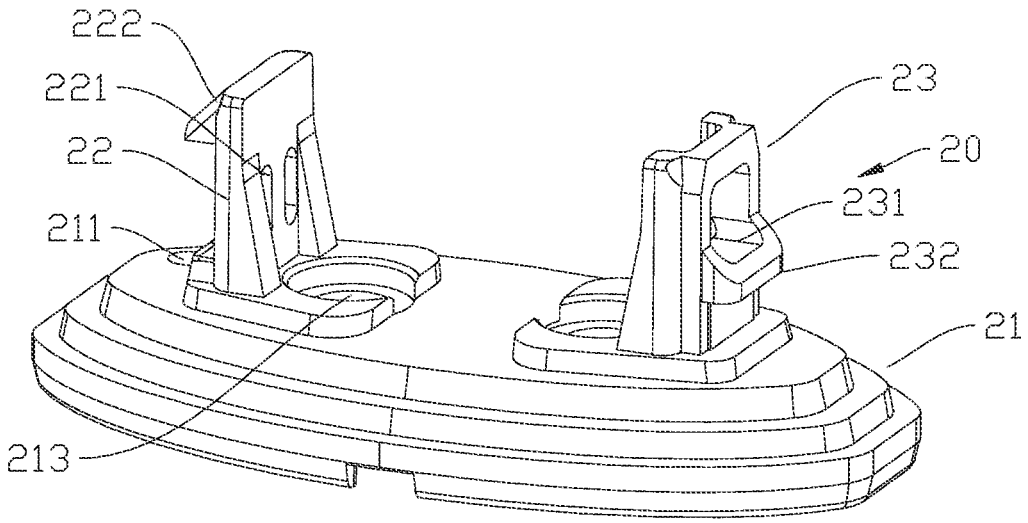
FIG. 11 is a perspective view of the base of the atomizer shown in FIG. 8.
Figure 12:
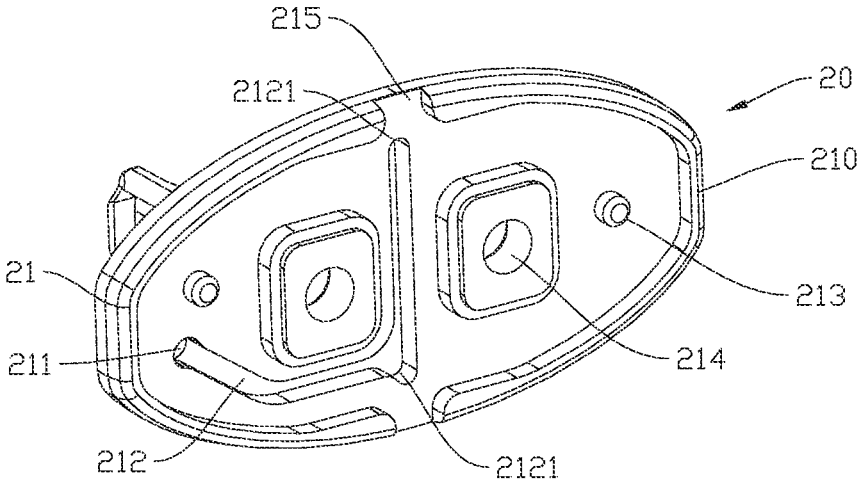
FIG. 12 is a perspective view of the base shown in FIG. 11, viewed from another direction.

As shown in FIGS. 5 and 11, in some embodiments, the atomization sleeve 50 can be detachably connected to the base 20. Specifically, in some embodiments, the atomization sleeve 50 can be detachably connected to the base 20 by a first connection component and a second connection component. The first connection component may include a first hook 222 and a first locking portion 52. The hook 222 can be arranged on the first support structure 22, and the first locking portion 52 can be arranged on the atomization sleeve 50 and located on one side of the atomization sleeve 50. The first locking portion 52 can be arranged corresponding to the first hook 222 and is configured for the first hook 222 to be snapped therein. The second connection component may include a second hook 232 and a second locking portion 53. The second hook 232 can be arranged on the second support structure 23, and the second locking portion 53 can be arranged on the atomization sleeve 50 and located on another side of the atomization sleeve 50. The second locking portion 53 can be arranged corresponding to the second hook 232 and is configured to be snapped with the second hook 232.

In some embodiments, the atomizer further includes an atomization assembly 60. The atomization assembly 60 is arranged in the atomization sleeve 50 and is arranged on the base 20. Specifically, the atomization assembly 60 can be arranged on the first support structure 22 and the second support structure 23. In some embodiments, the atomization assembly 60 includes a porous body 61 and a heating element 62. The porous body 61 may be a ceramic porous body. The porous body 61 can be in fluid communication with the liquid storage cavity 15. The porous body 61 includes a liquid absorbing surface 611 and an atomizing surface 612. The liquid absorbing surface 611 is arranged facing the liquid storage cavity 15 and can allow liquid to enter the porous body 61. The atomizing surface 612 can be arranged opposite to the liquid absorbing surface 611 and facing the atomization cavity 51. The atomizing surface 612 can be used for mounting the heating element 62. In some embodiments, the heating element 62 is arranged on the porous body 61. Specifically the heating element 62 can be arranged on the atomizing surface 612. The heating element 62 can generate heat in an energized state. In some embodiments, the heating element 62 can be a heating sheet. In some embodiments, the location of the first air outlet hole 231 may be higher than or equal to that of the atomizing surface 612. That is, the location of the first air outlet hole is not lower than the location of the atomizing surface 612 of the porous body 61. On one hand, the condensate at the bottom of the atomization cavity 51 is partially blocked, and on the other hand, the outflow of the aerosol is not disturbed, which improves the inhaling experience.

Further, in some embodiments, the atomizer further includes a sealing structure 70 which is sleeved on an upper portion of the atomization sleeve 50 and is located at the junction of the atomization sleeve 50 and the liquid storage cavity 15. The sealing structure 70 can be configured for sealing the gap between the atomization sleeve 50 and the housing 10. In some embodiments, the sealing structure 70 may be a silicone sleeve or a rubber sleeve. Understandably, in some other embodiments, it may not be limited to a silica gel sleeve or a rubber sleeve.

Further, in some embodiments, the atomizer further includes a suction nozzle 80. The suction nozzle 80 can be sleeved on the upper portion of the housing 10 with a space defined between the suction nozzle 80 and the housing 10. The space can be used to allow external air to enter the first air inlet 111 and the second air inlet 112.

Further, in some embodiments, the atomizer further includes a sealing sleeve 90. The sealing sleeve 90 can be sleeved on the upper portion of the housing 10 and located above the first air inlet 111, the second air inlet 112 and the air outlet 113 and between the suction nozzle 80 and the housing 10. In some embodiments, the sealing sleeve 90 may be a silicone sleeve.

Furthermore, in some embodiments, the atomizer further includes at least one electrode element 100. The at least one electrode element 100 may include two electrode poles which are respectively a positive pole and a negative pole. The two electrode poles can be arranged side-by-side on the base 20. One end of the electrode pole can be electrically connected to the heating element 62, and another end of the electrode pole is electrically connected to the power supply assembly 2.

Figure 15:
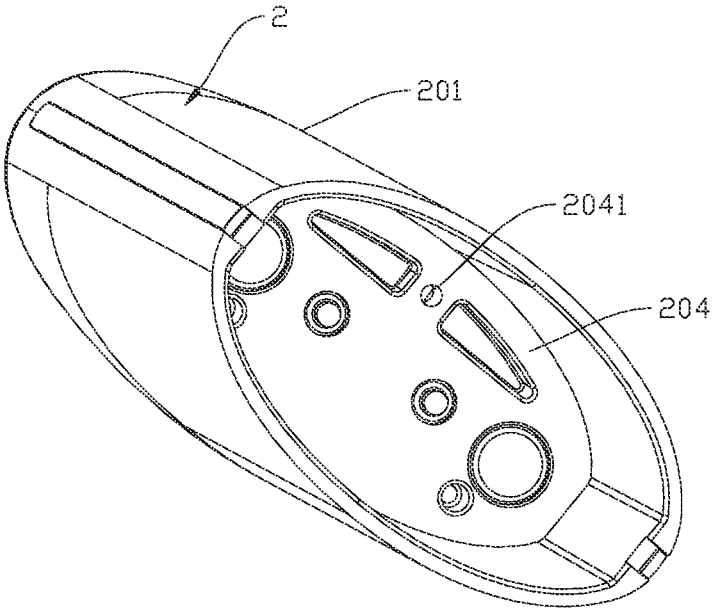
FIG. 15 is a schematic view of the power supply assembly of the electronic atomizing device shown in FIG. 1.

As shown in FIGS. 3 and 15, further, in some embodiments, the power supply assembly 2 may include a power supply housing 201, a battery 202, a pneumatic switch 203 and an isolation cover 204. The power supply housing 201 may be an elongated pipe, which is sleeved outside at least part of the atomizer 1 and can be used to receive the atomizer 1, the battery 202, and the pneumatic switch 203. The battery 202 is arranged in the power supply housing 201 and located at a lower portion of the power supply housing 201. The battery 202 is electrically connected to the atomizer 1 to supply power to the atomizer 1. The pneumatic switch 203 is arranged in the power supply housing 201. The pneumatic switch 203 is electrically connected to the battery 202 and in communication with the air sensing passage 17. The pneumatic switch 203 can sense the change of the airflow in the air sensing passage 17. When the pneumatic switch 203 senses an air flowing, the pneumatic switch transmits a signal to a controller, so that the battery 202 can power the atomizer 1, and the atomization assembly 60 can heat and atomize the atomizable medium. When the pneumatic switch senses no air flowing, no signal is transmitted to the controller, and the battery 202 stops powering the atomizer 1. In some embodiments, the pneumatic switch 203 may be a microphone. The isolation cover 204 can be arranged in the power supply housing 201 and can divide the power supply housing 201 into two chambers, one for the installation of the atomizer 1, and another for the installation of the battery 202 and the pneumatic switch 203. The atomizer 1 and the battery 202 are isolated by the isolation cover 204. The isolation cover 204 is provided with at least one second air inlet hole 2041. One second air inlet hole 2041 may be provided, and may communicate with one air pipe 42 to further communicate the air sensing passage 17 of the atomizer 1 with the pneumatic switch 203.

It should be understandable that the above embodiments are only preferred embodiments of the disclosure, and the description thereof is more specific and detailed, but it is not to be construed as limiting the scope of the patent of the disclosure. It should be noted that a person skilled in the art can freely combine the foregoing technical features and also can make several modifications and improvements without departing from the concept of the disclosure, and these modifications and improvements are all within the scope of protection of the present disclosure. Therefore, all equivalent transformations and modifications made according to the scope of the claims of the disclosure shall fall within the scope of the claims of the disclosure.

What is claimed is:

1. An atomizer, comprising a housing (10), wherein an atomization cavity (51) is defined in the housing (10); an air inlet passage (16) and an air sensing passage (17) which are in communication with the outside are defined in the housing (10); the air inlet passage (16) is in communication with the atomization cavity (51), the air sensing passage (17) is for in fluid communication with a pneumatic switch (203), and at least part of the air sensing passage (17) and at least part of the air inlet passage (16) are arranged side-by-side and independent of each other, wherein the housing (10) comprises a shell (11) a first partition wall (12), and a second partition wall (13);

the first partition wall (12) is arranged in the shell (11) along a longitudinal direction of the shell with a first space defined between the first partition wall (12 and a side wall of the shell (11);

the second partition wall (13) is arranged in the shell (11) along the longitudinal direction and is located between the first partition wall (12) and the side wall of the shell (11) to divide the first space into the air sensing passage (17) and the air inlet passage (16).

2. The atomizer according to claim 1, wherein all parts of the air sensing passage (17) and all parts of the air inlet passage (16) are arranged independently of each other.

3. The atomizer according to claim 1, wherein the air sensing passage (17) and the air inlet passage (16) are arranged along the longitudinal direction of the housing (10) and are parallel to each other.

4. The atomizer according to claim 3, wherein the housing (10) is provided with a first air inlet (111) in communication with the air inlet passage (16); and/or, the housing (10) is provided with a second air inlet (112) in communication with the air sensing passage (17).

5. The atomizer according to claim 4, wherein the housing (10) comprises a top end and a bottom end opposite to the top end;

the first air inlet (111) and the second air inlet (112) are arranged adjacent to the top end of the housing (10).

6. The atomizer according to claim 1, wherein an air outlet passage (18) to communicate the atomization cavity (51) with the outside is provided in the housing (10) for outputting aerosol, and the air outlet passage (18) and the air inlet passage (16) are respectively located at two opposite sides of the housing (10).

7. The atomizer according to claim 1, wherein the housing (10) comprises a third partition wall (14) arranged in the shell (11) along the longitudinal direction and opposite to and spaced apart from the first partition wall (12), a second space is defined between the third partition wall (14) and a side wall of the shell (11), and the second space defines the air outlet passage (18).

8. The atomizer according to claim 1, wherein the atomizer further comprises a base (20) and an atomization assembly (60) arranged on the base (20); the housing (10) is sleeved on the base (20); the atomization assembly (60) is arranged in the housing (10);

the base (20) comprises a base body (21), and a first support structure (22) and a second support structure (23) which are arranged on the base body (21) to support the atomization assembly (60); and the first support structure (22) and the second support structure (23) are arranged opposite to each other.

9. The atomizer according to claim 8, wherein the first support structure (22) is provided with a first air inlet hole (221) in communication with the air inlet passage (16) and the atomization cavity (51); and the second support structure (23) is provided with a first air outlet hole (231) in communication with the atomization cavity (51) and the air outlet passage (18).

10. The atomizer according to claim 9, wherein the atomization assembly comprises a porous body (61) which comprises an atomizing surface (612) facing the atomization cavity (51), and the location of the first air outlet hole (230 is higher than or equal to that of the atomizing surface (612).

11. The atomizer according to claim 8, wherein the atomizer further comprises a seat (30) sleeved on a lower portion of the housing (10) and a sealing member (40) arranged between the seat (30) and the base body (21), the sealing member (40) is provided with at least one air pipe (42) in communication with the air sensing passage (17); and the seat (30) is provided with at least one via hole (321) corresponding to the at least one air pipe (42).

12. The atomizer according to claim 11, wherein the at least one air pipe comprises two air pipes (42) which are arranged symmetrically.

13. The atomizer according to claim 11, wherein the at least one air pipe (42) protrudes from an end surface of an end of the seat (30) away from the housing (10).

14. An electronic atomizing device, comprising an atomizer (1) and a power supply assembly (2) connected to the atomizer (1); wherein, the atomizer (1) comprises a housing (10), and an atomization cavity (51) is defined in the housing (10); an air inlet passage (16) and an air sensing passage (17) which are in communication with the outside are defined in the housing (10); the air inlet passage (16) is in communication with the atomization cavity (51), and at least part of the air sensing passage (17) and at least part of the air inlet passage (16) are arranged side-by-side and independent of each other; and wherein the power supply assembly (2) comprises a pneumatic switch (203) in fluid communication with the air sensing passage (17), wherein the housing (10) comprises a liquid storage cavity (15) for storing liquid atomizable medium;

an air outlet passage (18) communicating the atomization cavity (51) with the outside is provided in the housing (10) for outputting aerosol; and the air outlet passage (18) and the air inlet passage (16) are respectively located at two opposite sides of the liquid storage cavity (15).

15. The electronic atomizing device according to claim 14, wherein the electronic atomizing device further comprises an air inlet hole (2041) arranged on the power supply assembly for communicating the air sensing passage (17) of the atomizer (1) with the pneumatic switch (203).

16. The electronic atomizing device according to claim 14, wherein the housing (10) comprises a shell (11), a first partition wall (12), and a second partition wall (13);

the first partition wall (12) is arranged in the shell (11) along a longitudinal direction of the shell with a first space defined between the first partition wall (12) and a side wall of the shell (11);

the second partition wall (13) is arranged in the shell (11) along the longitudinal direction and is located between the first partition wall (12) and the side wall of the shell (11) to divide the first space into the air sensing passage (17) and the air inlet passage (16).

17. The electronic atomizing device according to claim 16, wherein the housing (10) comprises a third partition wall (14) arranged in the shell (11) along the longitudinal direction and opposite to and spaced apart from the first partition wall (12), a second space is defined between the third partition wall (14) and the side wall of the shell (11), and the second space defines the air outlet passage (18).

18. The electronic atomizing device according to claim 14, wherein the air sensing passage (17) and the air inlet passage (16) are arranged along the longitudinal direction of the housing (10) and are parallel to each other.

19. An atomizer, comprising a housing (10), wherein an atomization cavity (51) is defined in the housing (10); an air inlet passage (16) and an air sensing passage (17) which are in communication with the outside are defined in the housing (10); the air inlet passage (16) is in communication with the atomization cavity (51), the air sensing passage (17) is for in fluid communication with a pneumatic switch (203), and at least part of the air sensing passage (17) and at least part of the air inlet passage (16) are arranged side-by-side and independent of each other;

wherein an air outlet passage (18) to communicate the atomization cavity (51) with the outside is provided in the housing (10) for outputting aerosol, and the air outlet passage (18) and the air inlet passage (16) are respectively located at two opposite sides of the housing (10).

* * * * *